United States Patent [19]

Orenstein et al.

[11] Patent Number: 4,674,985

[45] Date of Patent: Jun. 23, 1987

[54] TOY WITH ENCODED IDENTIFICATION ELEMENT

[75] Inventors: Henry Orenstein, West Caldwell, N.J.; George Dunsay, Boston, Mass.

[73] Assignee: Hasbro Bradley, Inc., Pawtucket, R.I. ; a part interest

[21] Appl. No.: 748,666

[22] Filed: Jun. 24, 1985

[51] Int. Cl.[4] ..... A63H 3/36

[52] U.S. Cl. ..... 446/14; 446/385

[58] Field of Search ..... 446/14, 385, 295, 267, 446/268; 40/448; 63/32; 272/8 N, 8 R; 428/1

[56] References Cited

U.S. PATENT DOCUMENTS 3,647,279 3/1972 Sharpless et al. ..... 63/32 UX

*Primary Examiner*—Mickey Yu

*Attorney, Agent, or Firm*—Salter & Michaelson

[57] ABSTRACT

A toy construction having a toy element which is preferably embodied in a toy character figure, and a liquid crystal identification element on the toy element. The identification element is operative by the application of a small amount of heat thereto to change it from a non-displaying condition wherein an identifying image thereon is imperceptible and a displaying condition wherein the image is clearly visible. Hence, the identity of the character figure is normally concealed but can be readily revealed by a child when desired.

2 Claims, 3 Drawing Figures

TOY WITH ENCODED IDENTIFICATION ELEMENT

BACKGROUND AND SUMMARY OF THE INVENTION

The instant invention relates to toys and more particularly to a toy construction having an encoded identification display thereon.

It is well recognized that the concept of including some type of encoding means in a toy can substantially enhance the play value of the toy. Along this same line, it has now been found that the play value of a toy can also be enhanced by incorporating therein means which is operable by a child for determining the true identity of an otherwise unidentified toy character. This allows a child or a group of children to develop a number of intriguing imaginary situations which depend on the initially unknown identity of the character to provide the child or children with a substantial amount of amusement. For example, it has been found that the play value of a toy character figure can be substantially enhanced when it is constructed to include an encoded identification means thereon which initially conceals the true identity of the character as an alien invader from a hostile planet, but permits a child to determine the true identity of the character through the actuation of the identification means on the toy.

The instant invention provides a novel and interesting toy construction, wherein the true identity or character of the toy is initially imperceptible, but can easily be determined by the actuation of an identification means on the toy when desired. More specifically, the toy construction of the instant invention comprises a toy element which may be embodied in a variety of different configurations, but which is preferably embodied as a toy character figure, such as a robotic character figure, and a liquid crystal identification means on the toy element. The liquid crystal identification means is operable by the application of heat thereto for changing it between a non-displaying condition wherein the image is invisible, and a displaying condition wherein an identifying image is visible thereon. Preferably, the identification means has a displaying surface thereon and it is changeable from the non-displaying condition thereof to the displaying condition thereof by manually rubbing the displaying surface with one's finger to produce a small amount of heat. Accordingly, the identification means on the toy is preferably normally maintained in a non-displaying condition so that the identity of the character figure is concealed, but when the displaying surface on the identification means is manually rubbed with a finger to apply heat thereto, an identifying image appears on the displaying surface so that the true identity of the character figure is revealed. Hence, the toy can be effectively utilized by a child or a group of children in a number of imaginary situations wherein the identity of the character figure is initially unknown and similarly, when several of the toys are used by a group of children, the different identities of the different character figures are initially concealed, but they can be easily determined by the children when desired. It has been found that this can substantially enhance the play value of the toy of the instant invention. For example, when a group of children are playing with several of the toys of the instant invention and some of the toys embody representatives of the forces of evil and others embody representatives of the forces of good, the true identities of the character figures embodied in the toys are initially concealed and a variety of imaginary situations can be developed by the children which depend on the identities of the character figures. The children can, however, determine the true identities of the character figures when desired simply by manually rubbing the identification means. Accordingly, it is seen that the novel combination of identification means in a toy character figure can substantially enhance the play value of the character figure.

It is, therefore, a primary object of the instant invention to provide a toy construction having an identification means which is operative between a non-displaying condition and a displaying condition for alternatively concealing and revealing the identity of the toy, respectively.

Another object of the instant invention is to provide a toy character figure with enhanced play value.

A still further object of the instant invention is to provide a toy character figure, wherein the identity of the character figure is intially concealed, but can easily be determined by a child.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
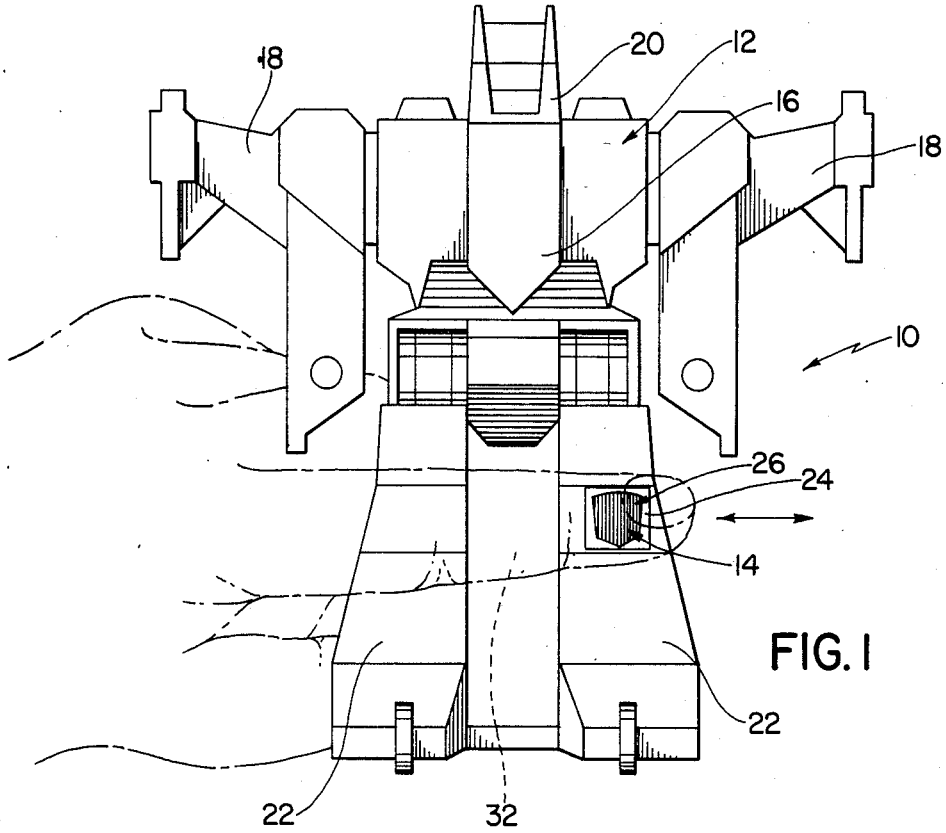
FIG. 1 is an elevational view of the toy of the instant invention illustrating the application of heat to the display element thereon.

Referring now to the drawing, the toy of the instant invention is illustrated and generally indicated at 10 in FIG. 1. The toy 10 comprises a toy element generally indicated at 12 and a liquid crystal identification element generally indicated at 14 which is mounted on the toy element 12. The liquid crystal identification element 14 is operable by the selective application of heat thereto for changing it from a non-displaying condition wherein an identifying image thereon is imperceptible, to a displaying condition wherein the image is visible. Accordingly, the identity of the character embodied in the character figure 12 can be selectively displayed or concealed by the selective application of heat to the identification element 14.

The toy element 12 is preferably embodied in a character figure, such as a robotic character figure of the type illustrated in FIG. 1. In the toy as herein set forth, the character embodied in the toy element 12 comprises a robotic torso 16, and a pair of robotic arms 18, a robotic head 20 and a pair of robotic legs 22 which extend from the torso 16. The toy element 12 is preferably constructed of a suitable plastic material, and it is preferably formed in an interesting configuration which will enhance the play value of the toy 10.

Figure 2:
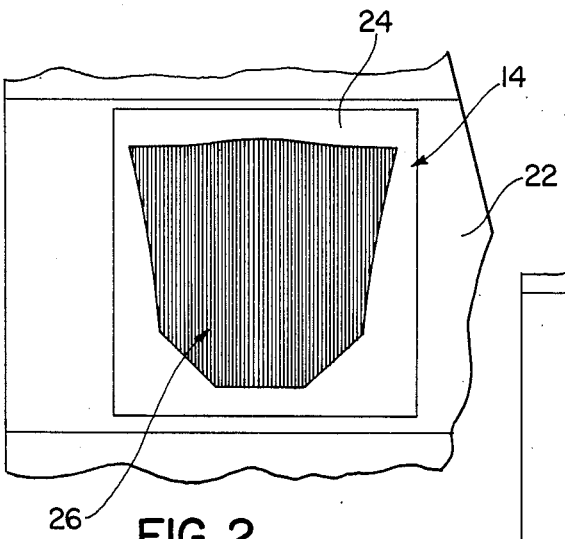
FIG. 2 is an enlarged view of the display element prior to the application of heat thereto.
Figure 3:
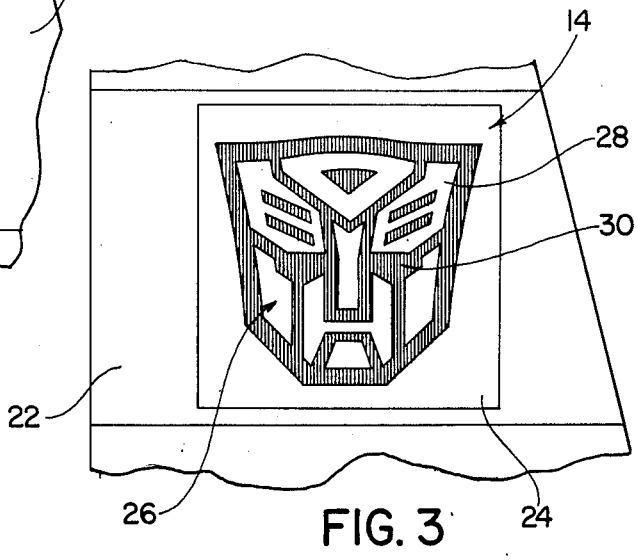
FIG. 3 is an enlarged view of the display element subsequent to the application of heat thereto.

The identification element 14, which is commercially produced by Takara Co., Ltd. of Tokyo, Japan, is more clearly illustrated in FIGS. 2 and 3, and it comprises a background portion 24 and a liquid crystal display portion 26 which is mounted on the background portion 24. The background portion 24 preferably comprises a substantially flat sheet having a first selected color and it preferably has an adhesive layer on the rear surface thereof for securing the identification element 14 on the toy element 12, and a protective transparent surface layer preferably extends across the front surface of the display element 14 for covering and protecting the liquid crystal display portion 26. The liquid crystal display portion 26 comprises a plurality of relatively thin liquid crystal portions 28 and border portions 30 which cooperate to define an identifying image in the display portion 26. The border portions 30 preferably have a second selected color which is different from the color of the background portion 24, and the liquid crystal portions 28 comprise liquid crystals of the type which are responsive to the application of heat thereto for producing color changes therein, such as crystals of the type utilized in the devices disclosed in the U.S. Pat. Nos. 3,861,213, Parker and 3,802,945, James. Further, the liquid crystals in the crystal portions 28 are formed and selected so that when they are in an unactuated condition prior to the application of heat thereto, they have said second color so that their appearance is substantially the same as that of the border portions 30, and the border portions 30 are preferably made of a material which is substantially non-responsive to heat. Accordingly, although the liquid crystal portions 28 and the border portions 30 cooperate to define an image in the display portion 26, when the crystal portions 28 are in an unactuated or non-displaying condition, the image in the display portion 26 is imperceptible as illustrated in FIG. 2. However, when a sufficient amount of heat is applied to the display portion 26, it is changed to the displaying condition thereof illustrated in FIG. 3. Specifically, the application of heat to the display portion 26 causes the crystal portions 28 to change color to a third selected color which contrasts said second color, whereas the border portions 30 remain unchanged, whereby a contrast is produced between the crystal portions 28 and the border portions 30 so that the identifying image in the display portion 26 is rendered perceptible. In this regard, preferably, the liquid crystals in the crystal portions 28 are selected so that they are activated or change color at approximately 30° C., whereby when they are at normal room temperature the display element 14 is in the non-displaying condition thereof, but when a small amount of heat is applied to the crystal portions 28, such as the amount of heat which is produced by rubbing a finger 32 over the display element 14, the liquid crystals in the crystal portions 28 are actuated to change the display element 14 to the displaying condition thereof.

Accordingly, in the preferred embodiment of the toy construction of the instant invention, the display element 14 is normally in a non-displaying condition so that the image in the display portion 26 is imperceptible and the true identity of the character embodied in the toy element 12 is concealed. However, when a small amount of heat is applied to the display element 14, such as the heat which is produced when it is rubbed by a finger, the identity of the character embodied in the toy 10 is revealed. Hence, it is seen that the addition of the display element 14 to the toy element 12 substantially enhances the play value of the toy 10. Accordingly, it is seen that the toy of the instant invention represents a significant advancement in the toy art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a toy character figure, apparatus for selectively displaying an image representative of toy character identity, comprising an identification element mounted on said toy character figure, said element comprising a substantially flat background sheet having a first selected color, a protective transparent surface layer covering said background sheet, image border portions, comprising material having a second selected color, contrasting said first selected color, arranged in a preselected pattern defining said image between said background sheet and said surface layer, and liquid crystal material arranged between said background sheet and said transparent layer and between said image border portions in a complementary pattern, said liquid crystal material being selected to have said second selected color at temperatures below a selected value and a third selected color, contrasting said second selected color at temperatures above said selected value.

2. Apparatus as specified in claim 1 wherein said selected temperature is approximately 30° C.

* * * * *